United States Patent [19]

Minegishi

[11] Patent Number: 5,062,400

[45] Date of Patent: Nov. 5, 1991

[54] DIESEL ENGINE SHUT-DOWN DEVICE

[75] Inventor: Masami Minegishi, Urawa, Japan

[73] Assignee: Fuji Jukogyo Kabushiki Kaisha, Tokyo, Japan

[21] Appl. No.: 622,412

[22] Filed: Dec. 4, 1990

[30] Foreign Application Priority Data

Dec. 14, 1989 [JP] Japan ..... 1-144719

[51] Int. Cl.[5] ..... F02B 77/00

[52] U.S. Cl. ..... 123/198 DB; 123/DIG. 11

[58] Field of Search ..... 123/198 D, 198 DB, 357, 123/358, 359, 373, DIG. 11

[56] References Cited

U.S. PATENT DOCUMENTS

| | | | |
|---|---|---|---|
| 4,111,175 | 9/1978 | Nakamura et al. | 123/DIG. 11 |
| 4,160,916 | 7/1979 | Papasideris | 123/DIG. 11 |
| 4,905,645 | 3/1990 | Bonse et al. | 123/198 DB |
| 4,924,827 | 5/1990 | Minegishi | 123/198 DB |

*Primary Examiner*—Noah P. Kamen

*Attorney, Agent, or Firm*—Beveridge, DeGrandi & Weilacher

[57] ABSTRACT

There is provided a diesel engine shut-down device for stopping a diesel engine by actuating an engine shut-down mechanism with an actuator when an engine key switch is turned off. The device comprises a key switch detector for detecting the ON/OFF state of the key switch and for producing an engine stop signal when the key switch is in the OFF state, a rotation detector responsive both to the engine stop signal for detecting a rotation state of the engine so as to produce an actuator drive signal when the engine is rotating, an actuator driver responsive to the actuator drive signal for driving the actuator and a timer for stopping the production of the engine stop signal when a predetermined period of time elapses after the key switch is turned off, to stop the actuator after elapsing of the predetermind period of time even if the engine is not stopped though the actuator has operated.

5 Claims, 4 Drawing Sheets

DIESEL ENGINE SHUT-DOWN DEVICE

BACKGROUND OF THE INVENTION

This invention relates to a shut-down device for a diesel engine, and more particularly, relates to a device for stopping the engine by cutting fuel and/or air.

In general, the diesel engine which is driven by self ignition of a fuel with compressed heat is stopped by cutting fuel after operating a stop lever or closing a switch valve provided in an intake system to cut intake air.

Each of Japanese Utility model laid-open NOS. 1986-167436 and -171843 disclose an engine that is stopped by turning a key switch in the "accessory" mode to turn on a shut-down solenoid. The solenoid forces a control rack of an fuel injection pump to be transferred to a position where the engine is stopped.

In the above prior art, the key switch should be in the "accessory" mode until the engine stops. However, if the key switch happens to be left in the "accessory" mode after the engine stops, a battery consumes electric power excessively. This drains the battery and makes it difficult for the engine to restart.

There is an engine shut-down device employing a timer disclosed in Japanese Patent NO. 1981-1464 in order to solve the above problem. This engine shut-down device operates as follows: When a key switch is turned off in order to stop a diesel engine, a timer starts simultaneously and a solenoid control device also operates to supply an electric power to a solenoid from a power supply while the timer is operating. The solenoid actuates to cut the fuel. The engine therefore stops.

However, in this prior art, the timer needs a sufficient interval of time for the engine to stop after a fuel system is shut down. Moreover, the interval of time should be long enough to cover shut down variations of the engine. The solenoid thus continues to operate while the timer is operating even after the engine stops. This causes electric power to be excessively consumed. Accordingly, the solenoid is heated excessively even if the solenoid has a short maximum rated energizing time and there is a load on the battery.

Furthermore, if fuel feed is not shut down after the key switch is turned off due to such as mechanical malfunction of a fuel feed shut-down device so that the engine does not stop automatically, the solenoid may be applied with electric power beyond its maximum rated energizing time. The solenoid may therefore be burned out.

SUMMARY OF THE INVENTION

An object of the invention is to provide a diesel engine shut-down device which reduces the current consumed by an engine shut-down actuator when a diesel engine stops and prevents the engine shut-down actuator from being burned out even if the engine does not stop due to malfunction of a shut-down mechanism.

In carrying out our invention in one preferred mode, we utilize a diesel engine shut-down device for stopping a diesel engine by actuating an engine shut-down mechanism with an actuator when an engine key switch is turned off.

The device comprises a key switch detecting section for detecting the ON/OFF state of the key switch and for producing an engine stop signal when the key switch is in the OFF state, a rotation detecting section responsive to the engine stop signal for detecting a rotation state of the engine and for producing an actuator drive signal when the engine is rotating, an actuator drive section responsive to the actuator drive signal for driving the actuator and a timer section for stopping the production of the engine stop signal when a predetermined period of time elapses after the key switch is turned off, wherein the actuator is stopped when the predetermined period of time elapses even if the engine is not stopped though the actuator has been operated.

The other objects and features of this invention will become understood from the following description with reference to the accompanying drawings.

DETAILED DESCRIPTION OF THE PREFERRED EMBODIMENTS

The present invention will now be described in detail with reference to the accompanying drawings.

Figure 1:
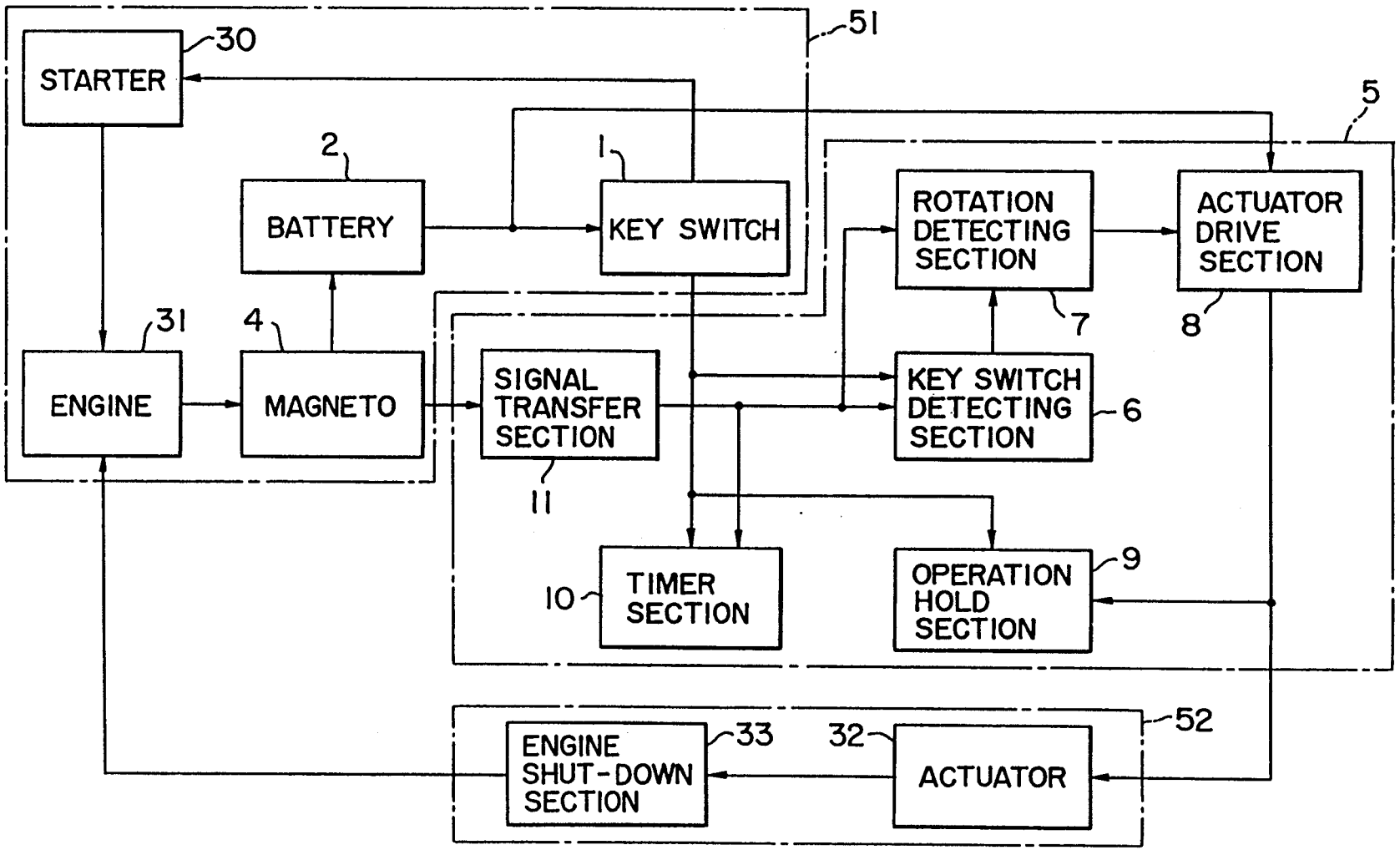
FIG. 1 is a block diagram showing a basic configuration of a diesel engine shut-down device of a first preferred embodiment according to the present invention.

FIG. 1 is a block diagram showing a basic configuration of a preferred embodiment of a diesel engine shut-down device according to the present invention.

The engine shut-down device has an engine system 51, an engine shut-down circuit 5 and an engine shut-down system 52.

The engine system 51 comprises a key switch 1, a battery 2, a magneto 4, a starter 30 and an engine 31.

The engine shut-down circuit 5 comprises a key switch detecting section 6, a rotation detecting section 7, an actuator drive section 8, an operation hold section 9 and a signal transfer section 11.

The engine shut-down system 52 comprises an actuator 32 and an engine shut-down section 33.

Figure 2:
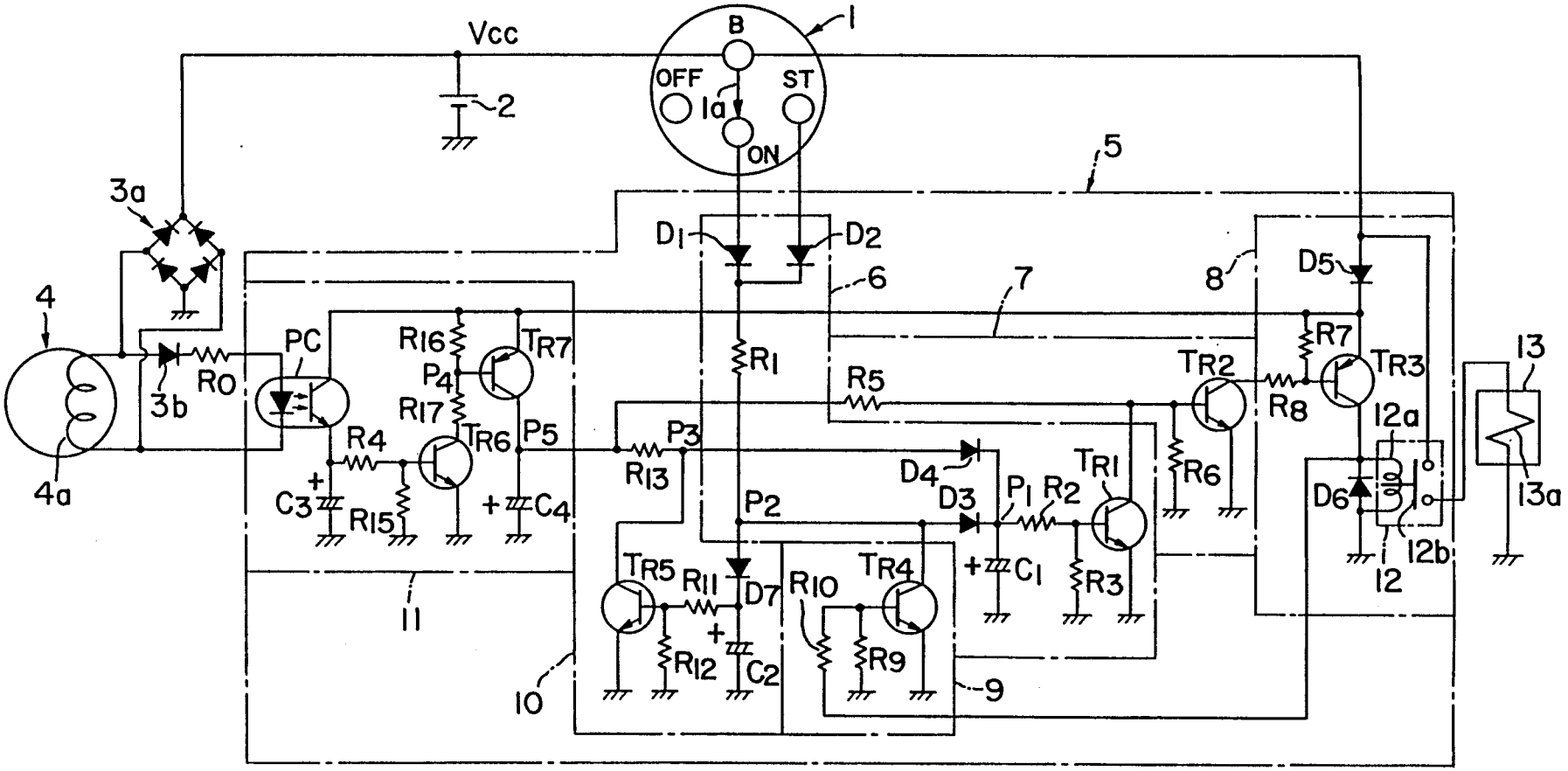
FIG. 2 shows a circuit diagram of the first preferred embodiment according to the present invention.

FIG. 2 shows a detailed circuit of the engine shut-down device according to the present invention.

In FIG. 2, the key switch 1 includes OFF, ON and ST (starter) terminals. The key switch is also provided with a terminal B, having a movable contact point 1*a* selectively shifted to each of the terminals, which is connected to the battery 2 and to a charge coil 4*a* of the magneto 4 via a rectifier 3*a* (a full-wave rectifier of a diode bridge).

One of the output terminals of the charge coil 4*a* is connected to a rectifier 3*b* (a half-wave rectifier of a diode) which is connected to an engine shut-down circuit 5 via a resistor $R_0$.

As is already mentioned, the engine shut-down circuit 5 comprises the key switch detecting section 6, the rotation detecting section 7, the actuator drive section 8, the operation hold section 9, the timer section 10 and the signal transfer section The shut-down circuit 5 is further provided with a photocoupler PC which isolates the output of the charge coil 4a to reject noise therefrom.

In the key switch detecting section 6, an anode of a diode $D_1$ is connected to the ON terminal and that of a diode $D_2$ to the ST terminal. Cathodes of the diodes $D_1$ and $D_2$ are connected to each other and to a resistor $R_1$. A diode $D_3$ is connected to the diodes $D_1$ and $D_2$ in forward direction via the resistor $R_1$.

A cathode of the diode $D_3$ is connected to one terminal of a capacitor $C_1$ of which the other terminal is grounded. A cathode of a diode $D_4$ and a resistor $R_2$ are together connected to a connection point $P_1$ of the capacitor $C_1$ and the diode $D_3$. A base of an NPN-type transistor $TR_1$ is also connected to the point $P_1$ via the resistor $R_2$. Connected to the base of the transistor $TR_1$ is one terminal of a bias resistor $R_3$ of which the other terminal is grounded. An anode of the diode $D_4$ is connected to a capacitor $C_4$ of the signal transfer section 11 via a resistor $R_{13}$.

In the rotation detecting section 7, a collector of the transistor $TR_1$ and one terminal of a resistor $R_5$ are together connected to a base of an NPN-type transistor $TR_2$ of which an emitter is grounded. Also connected to the base of the transistor $TR_2$ is one terminal of a bias resistor $R_6$ of which the other terminal is grounded. The other terminal of the resistor $R_5$ is connected to the capacitor $C_4$.

In the actuator drive section 8, an anode of a diode $D_5$ is connected to the terminal B of the key switch 1. A cathode of the diode $D_5$ is connected to an emitter of a PNP-type transistor $TR_3$. A resistor $R_7$ is connected across the emitter and a base of the transistor $TR_3$. The base of the transistor $TR_3$ is connected to a collector of the transistor $TR_2$ via a resistor $R_8$.

Connected to a collector of the transistor $TR_3$ is one terminal of an excitation winding 12a of a relay switch 12 to which a surge absorbing diode $D_6$ is connected in parallel. The other terminal of the winding 12a is grounded. One contact point of a relay contact 12b of the relay switch 12 is connected to the battery 2 via the terminal B of the key switch 1. The other contact point of the relay contact 12b is connected to an excitation winding 13a of a solenoid 13 which is an example of the actuator 32.

In the operation hold section 9, a collector of an NPN-type transistor $TR_4$ is connected to the anode of the diode $D_3$ A base of the transistor $TR_4$ is connected to one terminal of a bias resistor $R_9$ of which the other terminal is grounded. The base of the transistor $TR_4$ is further connected to the collector of the transistor $TR_3$ via a resistor $R_{10}$.

In the timer section 10, an anode of a diode $D_7$ is connected to a connection point $P_2$ of the resistor $R_1$ and the diode $D_3$ Connected to a cathode of the diode $D_7$ is one terminal of a resistor $R_{11}$ and that of a capacitor $C_2$ of which the other terminal is grounded.

The other terminal of the resistor $R_{11}$ is connected to a base of an NPN-type transistor $TR_5$ of which an emitter is grounded. The base of the transistor $TR_5$ is connected to one terminal of a resistor $R_{12}$ of which the other terminal is grounded. A collector of the transistor $TR_5$ is connected to a connection point $P_3$ of the diode $D_4$ and the resistor $R_{13}$.

In the timer section 10, a time constant TSET determined by the capacitance of the capacitor $C_2$ and the resistance of the resistor $R_{11}$ is arranged such that it is longer than the period of time until the engine 31 stops after the key switch 1 is turned off and is shorter than the rated maximum power applying time of the solenoid 13.

In the signal transfer section 11, a collector of a phototransistor of the photocoupler PC is connected to the terminal B of the key switch 1 via the diode $D_5$. An emitter of the phototransistor is connected to one terminal of a capacitor $C_3$ of which the other terminal is grounded.

The emitter of the phototransistor is further connected, via a resistor $R_4$, to a base of a transistor $TR_6$ and one terminal of a resistor $R_{15}$ of which the other terminal is grounded. A collector of the transistor $TR_6$ is connected to a collector of the phototransistor and an emitter of a PNP-type transistor $TR_7$ via resistors $R_{16}$ and $R_{17}$.

A base of the transistor $TR_7$ is connected to a connection point $P_4$ of the resistors $R_{16}$ and $R_{17}$. A collector of the transistor $TR_7$ is connected to one terminal of the capacitor $C_4$ of which the other terminal is grounded at a connection point $P_5$.

The connection point $P_5$ is connected to the base of the transistor $TR_1$ in the key detecting section 6 via the resistor $R_{13}$, diode $D_4$ and resistor $R_2$. The connection point $P_5$ is also connected to the base of the transistor $TR_2$ via the resistor $R_5$ in the rotation detecting section 7 and further to the collector of the transistor $TR_5$ in the timer section 10 via the resistor $R_{13}$.

The solenoid 13 is linked to an adjustment mechanism for adjusting a quantity of fuel to be fed. The adjustment mechanism is also the engine shut-down section 33 for the shut down of feed of the fuel to the engine.

Figure 3:
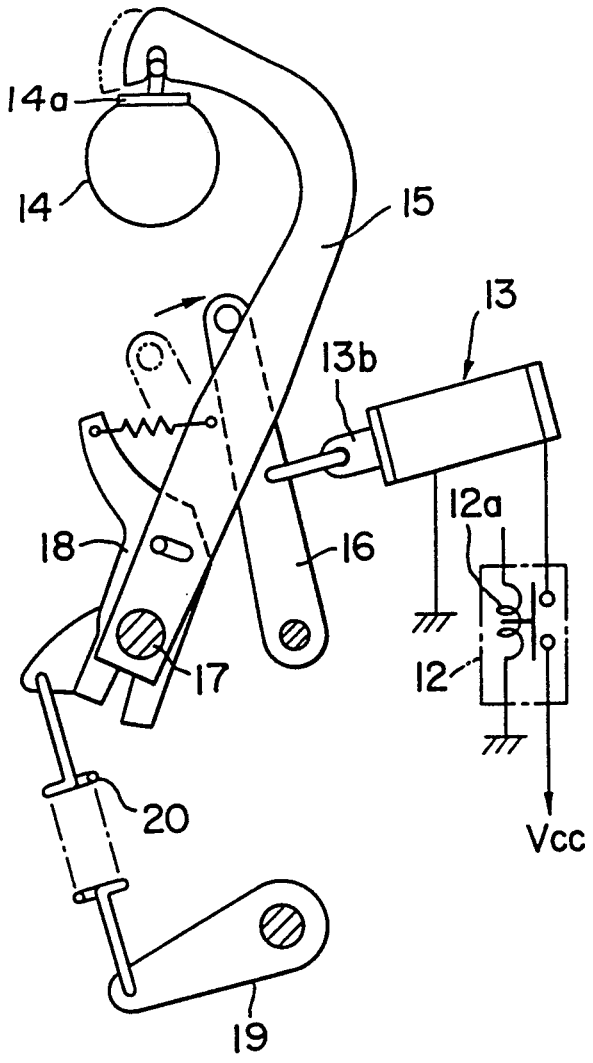
FIG. 3 is a schematic diagram of a governor device of the preferred embodiment according to the present invention.

As is shown in FIG. 3, a governor lever 15 is linked to a control rack 14a which sets an injection quantity of the fuel from a fuel injection pump 14. Further linked to the governor lever 15 is a stop lever 16 for forcing the governor lever 15 to rotate to the stop position indicated by a solid line in the FIG. 3. A plunger 13b of the solenoid 13 is further linked to the stop lever 16.

While the engine 31 is being normally driven, the plunger 13b protrudes from the solenoid 13 and the stop lever 16 is in the position where the stop lever 16 is separated by a distance from the governor lever 15 as indicated by a broken line in FIG. 3.

The governor lever 15 is pivotally supported by a governor shaft 17. A governor weight not shown, which energizes the governor shaft 17 in a direction of low engine speed (a clockwise direction in FIG. 3) utilizing centrifugal force induced by rotation of the engine 31, is provided so as to face the governor shaft 17.

A control link 18 linked to the governor lever 15 is further linked to a control lever 19 via a governor spring 20.

In operation, the movable contact point 1a of the terminal B of the key switch 1 in FIG. 2 is first shifted to the ON terminal from the OFF terminal. A charge current flows into the engine shut-down circuit 5 from the battery 2.

In the circuit 5, the charge current flows to the capacitor $C_2$ via the diode $D_1$, the resistor $R_1$ and the diode $D_3$, because the transistor $TR_4$ is off.

A voltage induced to the capacitor $C_1$ is applied to the base of the transistor $TR_1$ to produce a base current which flows therethrough via the resistor $R_2$ and the bias resistor $R_3$.

The charge current further flows to the capacitor $C_2$ via the diode $D_1$, the resistor $R_1$ and the diode $D_7$. A voltage induced to the capacitor $C_2$ is applied to the base of the transistor $TR_5$ via the resistor $R_{11}$ and the bias resistor $R_{12}$.

Both the transistors $TR_1$ and $TR_5$ are thus turned on. This makes the potential of the base of the transistor $TR_2$ about ground level so that the transistor $TR_2$ is turned off. The transistor $TR_3$ is also turned off to keep both the relay switch 12 and the solenoid 13 off.

The movable contact point 1*a* of the terminal B of the key switch 1 is next shifted to the ST terminal from the ON terminal to operate the starter 30 so as to start the engine 31. And then, the movable contact point 1*a* is returned to the ON terminal.

When the engine 31 starts, an a.c. voltage is induced to the charge coil 4*a* of the magneto 4. The a.c. voltage is then rectified by the rectifier 3*a* to produce a full-wave d.c. voltage which is charged by the battery 2.

The a.c. voltage is further rectified by the rectifier 3*b* to produce a half-wave d.c. voltage which is then applied to the engine shut-down circuit 5 via the resistor $R_0$.

When the the half-wave d.c. voltage is applied to the photocoupler PC, its phototransistor is turned on so that a charge current flows to the capacitor $C_3$. A voltage induced in the capacitor $C_3$ is applied to the base of the transistor $TR_6$ via the resistor $R_4$ and the bias resistor $R_{15}$ to turn on the transistor $TR_6$.

When the transistor $TR_6$ is turned on, the transistor $TR_7$ is further turned on so that a charge current flows to the capacitor $C_4$. The half-wave d.c. current is thus smoothed out.

A voltage induced in the capacitor $C_4$ is applied to the key switch detecting section 6, the rotation detecting section 7 and the timer section 10. A discharge current from the capacitor $C_4$ flows to ground via the resistor $R_5$ and transistor $TR_1$ already turned on and also via the resistor $R_{13}$ and transistor $TR_5$.

Therefore, the transistor $TR_2$ of the rotation detecting section 7 is kept off along with the transistor $TR_3$ of the actuator drive section 8.

When the engine 31 is normally driven, in FIG. 3, the control rack 14*a* of the fuel injection pump 14 is operated by balance of the governer weight not shown and the governer spring 20 to constantly control an engine speed.

Next, the contact point 1*a* of the key switch 1 in FIG. 2 is shifted to the ON terminal to the OFF terminal so as to stop the engine 31. The base current of the transistor $TR_1$ is cut off so that the transistor $TR_1$ is turned off to produce an engine stop signal. Also, the charge current to the capacitor $C_2$ is cut off. After that, the transistor $TR_5$ is kept on until a period of time corresponding to the time constant TSET determined by the resistance of the resistor $R_{11}$ and the capacitance of the capacitor $C_2$ elapses.

When the transistor $TR_1$ is turned off, a discharge current from the capacitor $C_4$ flows to the transistor $TR_5$ while turned on, via the resistor $R_{13}$. The discharge current further flows to the resistor $R_6$ via the resistor $R_5$ so that the transistor $TR_2$ is biased to produce a base current. The transistor $TR_2$ is thus turned on to produce a drive signal.

Therefore, the transistor $TR_3$ of the actuator drive section 8 is turned on and then a current is supplied to the excitation winding 12*a* of the relay switch 12 from the battery 2 to turn on the relay contact point 12*b*. The current from the battery 2 is thus supplied to the excitation winding 13*a* of the solenoid 13.

As a result, in FIG. 3, the stop lever 16 is pulled in the clockwise direction by the plunger 13*b* of the solenoid 13. The governer lever 15 is thus forced to rotate in the same direction, that is, the direction of engine stop to operate the control rack 14*a* of the fuel injection pump 14, linked to the governer lever 15 so as to shut down fuel feed. The engine 31 therefore stops.

When the relay switch 12 is turned on, the potential of the collector of the transistor $TR_3$ becomes high level so that a base bias voltage is applied to the base of the transistor $TR_4$ via the resistor $R_1$ and the bias resistor $R_9$. The transistor $TR_4$ is thus turned on.

Therefore, even if the contact point 1*a* of the key switch 1 is erroneously shifted to the ON terminal before the engine 31 stops, the current flowing to the engine shut-down circuit 5 from the battery 2 is grounded via the diode $D_1$, the resistor $R_1$ and the transistor $TR_4$. The transistor $TR_1$ is thus kept off so that the transistors $TR_2$ and $TR_3$ are kept on.

When the engine 31 is completely stopped and the charge coil 4*a* produces no output, the transistor $TR_2$ is turned off along with the transistor $TR_3$. Current supply to the exciting winding 13*a* of the solenoid 13 is thus stopped so that the solenoid 13 returns to its initial position.

That is to say, the solenoid 13 is turned off immediately after the engine 31 is stopped so that the electric power of the battery 2 is not wasted and the load on the battery 2 is lightened.

On the other hand, when the engine 31 is not stopped due to mechanical malfunction of the adjustment mechanism (the shut-down section 33) linked to the plunger 13*b* of the solenoid 13 so that fuel feed from the fuel injection pump 14 is not shut down in FIG. 3, it is needed to stop the engine 31 by operating the adjustment mechanism by hand. In this case, the adjustment mechanism is easily operated by hand, but the solenoid 13 may be powered for a long time and may be burned.

In the present invention, burning of the solenoid 13 can be prevented as follows:

When the key switch I is turned off and then the base current of the transistor $TR_1$ is cut off to turn off the transistor $TR_1$ in FIG. 2, the transistor $TR_2$ is turned on because the discharge current of the capacitor $C_4$ flows therethrough. The transistor $TR_3$ is further turned on while charging to the capacitor $C_2$ is cut off. After that, the transistor $TR_5$ is turned off when the period of time corresponding to the time constant TSET determined by the resistance of the resistor $R_{11}$ and the capacitance of the capacitor $C_2$ elapses.

In this case, when the engine 31 is not stopped, the input impedance of the transistor $TR_1$ with respect to the voltage induced to the capacitor $C_4$ is lowered because the resistors $R_2$ and $R_5$ are connected in parallel to each other via the resistor $R_{13}$. The current flowing from the capacitor $C_4$ to the resistor $R_2$, the bias resistor $R_3$ and the base of the transistor $TR_1$ via the diode $D_4$ is thus increased. The transistor $TR_1$ is therefore turned on.

The transistor $TR_2$ is then turned off along with the transistor $TR_3$. The relay switch 12 is further turned off to cut off power supplying to the solenoid 13.

Accordingly, the solenoid 13 is not continously powered until the engine 31 is stopped by forcely cutting of fuel feed by hand, even if the engine 31 is not stopped due to mechanical malfunction of the adjestment mechanism (the shut-down section 33) for cutting off fuel injection. Therefore, burning of the solenoid 13 is prevented.

Figure 4:
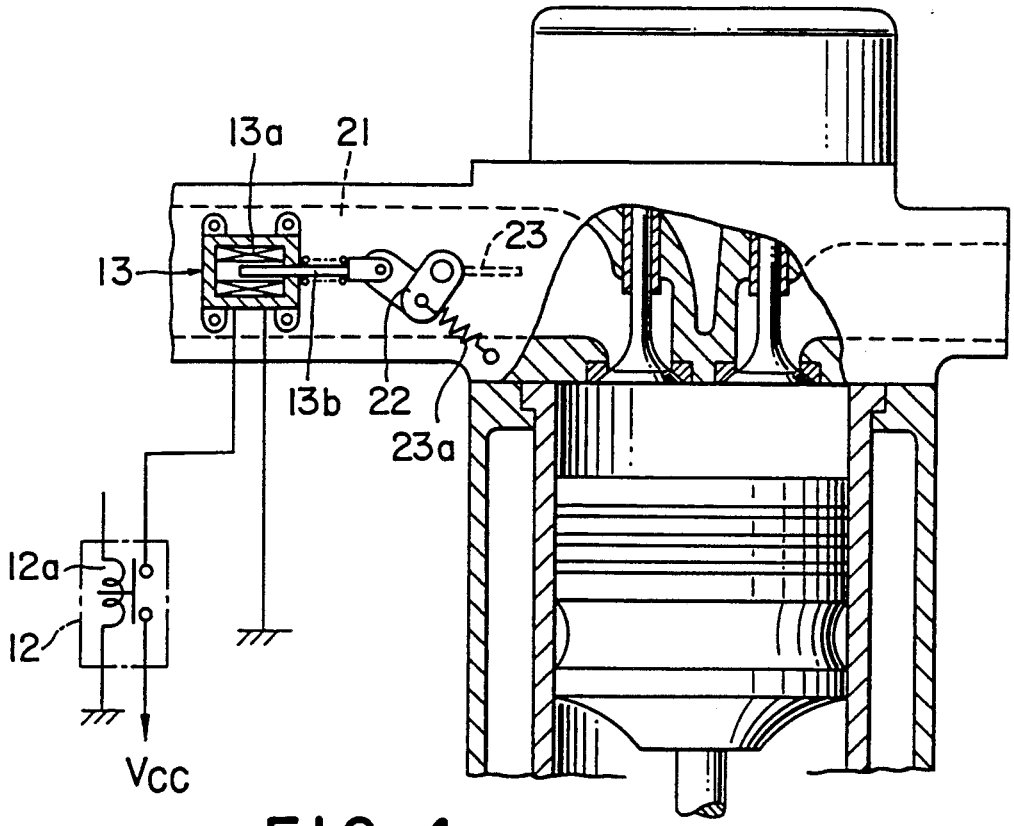
FIG. 4 is a front view of a main portion of an engine shut-down device in a state provided in an intake system of a second preferred embodiment according to the present invention.
Figure 5:
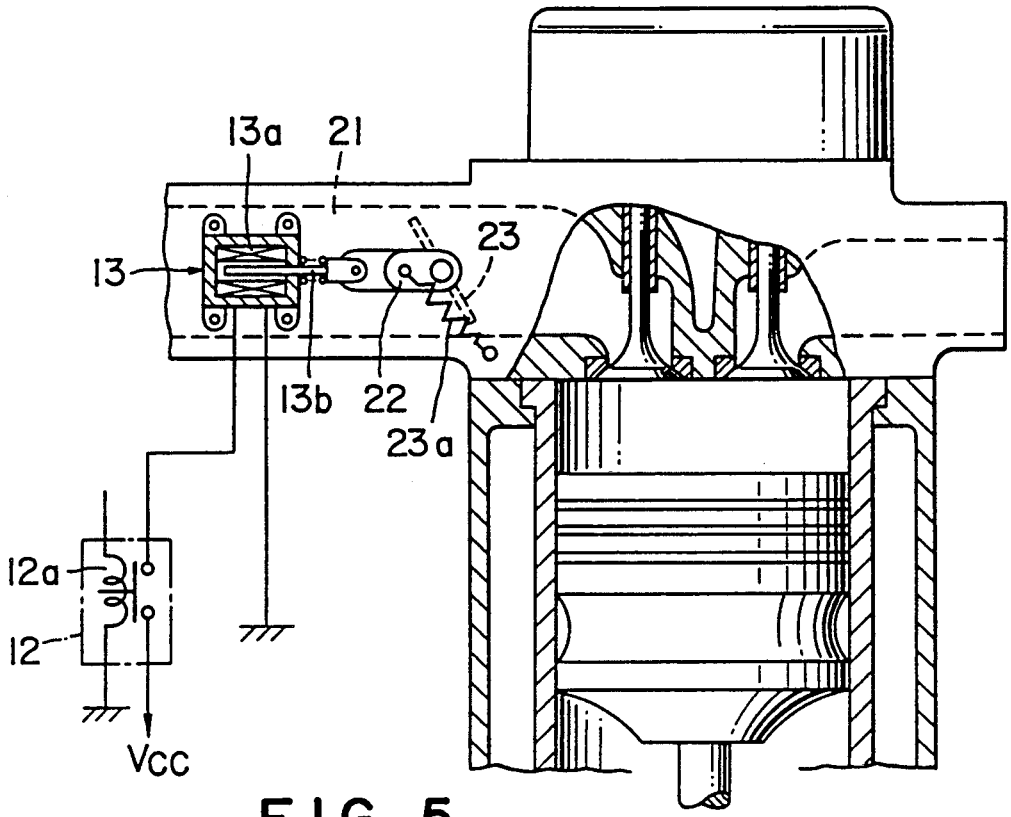
FIG. 5 is a front view of the main portion of the engine shut-down device in another state provided in the intake system of the second preferred embodiment according to the present invention.

Both FIGS. 4 and 5 show another preferred embodiment of the present invention, in which the engine 31 is stopped by restricting a quantity of intake air.

When a relay switch 12 provided in the actuator drive section 8 in the engine shut-down circuit 5 is turned on, an excitation winding 13*a* of a solenoid 13 is powered. The solenoid 13 is an example of the actuator 32 and is mounted on an outer wall of an intake pipe 21. A plunger 13*b* of the solenoid 13 then goes backwards to close a switching valve 23 provided in the intake pipe 21 via a link 22. The quantity of intake air is thus restricted to stop the engine 31. (the state shown in FIG. 4)

On the other hand, when the relay switch 12 is turned off, the switching valve 23 is again opened due to a force applied by a return spring 23*a*. (the state shown in FIG. 5)

The present invention should not be limited to the preferred embodiments described as above. The engine to which the present invention is applied is not only an industrial utility engine but also a diesel engine mounted on a vehicle.

The actuator is not only a solenoid but also a hydraulic actuator. In FIG. 3, it is applicable to directly enerzise the control rack 14*a* of the fuel injection pump 14 in the direction in which the engine 31 will be stopped. Furthermore, it is applicable to directly drive the engine shut-down device by a drive means.

As is understood from the foregoing, the present invention comprises a key switch detecting section for detecting the mode of the key switch and for producing an engine stop signal when the key switch is turned off, a rotation detecting section responsive to the engine stop signal for detecting engine speed and for producing a drive signal, an actuator drive section responsive to the drive signal for driving an engine shut-down actuator and a timer section for shutting down the operation of the rotation detecting section when a predetermined period of time elapses after the key switch is turned off.

Therefore, in the case of stopping the engine, very little current is wasted when the engine is rotated, and moreover, the engine shut-down actuator is driven within the predetermined period of time.

Furthermore, even if the engine is not automatically stopped due to mechanical malfunction of the shut-down mechanism linked to the actuator, the actuator is prevented from being burned out due to extended operation thereof.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A diesel engine shut-down device for stopping a diesel engine having engine shut-down means for cutting at least one of a fuel and an intake air, an actuator linked to actuate the engine shut-down means, and an engine key switch, comprising:

key switch detecting means for detecting an ON/-OFF state of the key switch and producing an engine stop signal when the key switch is in the OFF state;

rotation detecting means responsive both to the engine stop signal and a rotation state of the engine so as to produce an actuator drive signal when the engine is rotating;

actuator drive means responsive to the actuator drive signal for driving the actuator; and timer means for stopping the production of the engine stop signal when a predetermined period of time elapses after the key switch is turned off, wherein the actuator is stopped when the predetermined period of time elapses even if the engine is not stopped though the actuator has operated.

2. The device according to claim wherein the predetermined period of time is longer than a minimum period of time required to stop the engine after the key switch is turned off and is shorter than a rated maximum power application time of the actuator.

3. The device according to claim 1, further comprising signal transfer means for converting the rotation state of the engine into an electric signal and for transferring the electric signal to the rotation detecting means.

4. The device according to claim 3, wherein the signal transfer means comprises a photocoupler.

5. The device according to claim 3, wherein the signal transfer means derives said electric signal from an electric generator.

* * * * *